US006070532A

United States Patent [19]

Halverson

[11] Patent Number: 6,070,532

[45] Date of Patent: Jun. 6, 2000

[54] HIGH ACCURACY PROJECTILE

[75] Inventor: Henry J. Halverson, Collinsville, Ill.

[73] Assignee: Olin Corporation, East Alton, Ill.

[21] Appl. No.: 09/067,580

[22] Filed: Apr. 28, 1998

[51] Int. Cl.[7] ..... F42B 12/02; F42B 12/34

[52] U.S. Cl. ..... 102/501; 102/509; 102/517; 102/526

[58] Field of Search ..... 102/439, 501, 102/506–510, 517, 524, 526

[56] References Cited

U.S. PATENT DOCUMENTS

| | | | |
|---|---|---|---|
| 854,923 | 5/1907 | Broad . | |
| 1,134,797 | 6/1915 | Wood . | |
| 1,187,867 | 6/1916 | Shinkle . | |
| 1,582,673 | 4/1926 | Fahrenwald | 102/524 |
| 3,154,016 | 10/1964 | Frey . | |
| 4,136,616 | 1/1979 | Schirneker | 102/38 |
| 4,685,397 | 8/1987 | Schirneker | 102/510 |
| 4,811,666 | 3/1989 | Lufty | 102/501 |
| 4,819,563 | 4/1989 | Bodet | 102/501 |
| 5,259,320 | 11/1993 | Brooks | 102/509 |
| 5,275,108 | 1/1994 | Chernicky | 102/439 |
| 5,811,723 | 9/1998 | Stone | 102/509 |

FOREIGN PATENT DOCUMENTS

| | | | |
|---|---|---|---|
| 4039544 | 7/1992 | Germany | 102/501 |

*Primary Examiner*—Harold J. Tudor
*Attorney, Agent, or Firm*—Wiggin & Dana; Gregory S. Rosenblatt

[57] ABSTRACT

A projectile having improved accuracy when fired over long ranges is formed from a monolithic block of a copper alloy. Proceeding from a nose to a heel of the projectile, is a fore portion with arcuate side walls, a body portion of substantially constant cross-sectional area that minimally contacts a rifled gun barrel, a drive band having a diameter effective to seal propellant gases and an aft portion that continuously decreases in diameter terminating at the heel. A cylindrical bore extends from an opened end at the nose to a closed end proximate to a transition plane between the fore portion and the body portion.

21 Claims, 5 Drawing Sheets

HIGH ACCURACY PROJECTILE

BACKGROUND OF THE INVENTION

1. Field of the Invention

This invention relates to a projectile having improved accuracy. More particularly, the projectile has a hollow point, a fore portion with a near tangential ogive and an aft portion with a boattail. The projectile is machined from a monolithic block of a copper alloy.

2. Description of Related Art

Medium caliber cartridges, that have a projectile diameter of between 0.3 inch and 0.6 inch, are widely used in military and sporting applications. The projectiles are often fired from a weapon over long distances, in excess of 1000 meters, and require a high degree of accuracy to hit the target. For example, the present 0.50 caliber cartridge used by the United States military for sniper applications is the grade A, MK211, multi-purpose cartridge (MPC).

A disadvantage with the MPC is relatively high cost due to the use of a component made from tungsten carbide and the multiplicity of components within the bullet. There is a need for a cartridge having accuracy at least comparable to the MPC at ranges of up to 1500 meters that further does not decrease the useful life of the weapon, has a loaded length within the existing 0.50 caliber specification for use in weapons having box-type magazines and is less costly to manufacture than the MPC.

A monolithic copper alloy hunting bullet is disclosed in U.S. Pat. No. 4,685,397 to Schirneker that is incorporated by reference in its entirety herein. The projectile is machined from tombac, a copper alloy that typically contains between 10% and 20%, by weight, of zinc, and has an ogival nose portion with side walls that appear linear when viewed in longitudinal cross-section, a rear portion that angles inward, typically referred to as a boattail and a generally cylindrical mid-portion disposed between the fore and aft portions. A blind hole extends from an opening at the front end of the bullet to a point within the mid-portion. A steel insert then seals the front end of the blind hole.

The projectile disclosed in U.S. Pat. No. 4,685,397 is not believed to satisfy the accuracy requirements for a 0.50 caliber match grade cartridge because the generally linear side walls of the ogival nose portion will cause excessive free flight or jump to engagement with the rifling of the barrel and the relatively large, constant diameter, mid-portion will likely decrease the useful life of the weapon through erosion of the barrel.

There remains, therefore, a need for a medium caliber projectile that retains the accuracy of the 0.50 caliber grade A, MK211 MPC capable of low cost manufacture, and does not have the disadvantages specified above for the prior art.

SUMMARY OF THE INVENTION

Accordingly, it is an object of the invention to provide a medium caliber projectile having an accuracy equivalent to the grade A, MK211 MPC that may be manufactured at a lower cost.

A feature of the projectile of the invention is that it is formed from a single piece of machinable brass. The projectile has a fore portion with arcuate side walls when viewed in longitudinal cross-section and a hollow cylindrical bore extending inward from the nose of the projectile. A body portion of the projectile has a diameter that is effective to make minimal contact with the peaks of the rifling of a gun barrel. A drive band portion has a diameter effective to impart spin to the projectile and to prevent the escape of propellant gases. An aft portion reduces in diameter toward the rear of the projectile for ballistic stability and acts to reduce aerodynamic drag.

Among the advantages of the projectile of the invention are that by being formed from a single piece of a brass alloy, it may be manufactured to very tight tolerances, thereby improving accuracy. A dual diameter mid-portion, comprising the body portion and the drive band, reduces wear to the rifling of the gun barrel and forms a gas tight seal. Another advantage of the invention is that the near tangential ogive on the fore portion of the bullet minimizes bullet jump, improving accuracy. Still another advantage of the invention is that a large frontal nose cavity shifts the center of gravity of the bullet rearward, improving accuracy. It is estimated that the hollow point accounts for about thirty-five percent improvement in accuracy over a similar design having a solid nose portion.

In accordance with the invention, there is provided a medium caliber projectile that is to be fired from a weapon having a rifled barrel. This rifled barrel has an interior bore of a first diameter and a barrel groove surface of a second diameter.

The projectile is formed from a monolithic copper alloy to have a generally circular latitudinal cross-section. The projectile has a fore portion and an aft portion with a mid-portion disposed therebetween. The fore portion extends from the nose of the projectile to a first transition plane and has arcuate sidewalls when viewed in longitudinal cross-section. These arcuate sidewalls constantly increase in latitudinal cross-sectional diameter from the nose to the first transition plane. A hollow cylindrical bore extends from an open end at the nose to a closed end proximate to the first transition plane.

The mid-portion of the projectile has a body portion of generally constant latitudinal cross-section extending from the first transition plane to a second transition plane and a drive band portion of generally constant latitudinal cross-section extending from the second transition plane to a third transition. The body has a latitudinal diameter that is effective to minimally contact the barrel rifling. The drive band has a latitudinal diameter effective to seal propellant gases behind the projectile.

The aft portion has a latitudinal diameter that constantly decreases from the third transition plane to the heel of the projectile. One preferred monolithic copper alloy bullet includes a fore portion extending along at least 30% of the projectile length from the nose to a first plane. Over a majority of the first length it has a continuously curving convex longitudinal profile. A mid portion extends from the first plane to a second plane and has fore and aft subportions. The fore subportion length is at least equal to the land diameter and, over a majority, has a longitudinal profile defining a first right circular cylindrical exterior surface having a diameter slightly larger than the land diameter and configured to cooperate with the lands to register the projectile centrally within the barrel when the cartridge is chambered in the weapon. Over a majority of its length, the aft subportion has a longitudinal profile defining a second right circular cylindrical exterior surface having a diameter greater than the diameter of the first right circular cylindrical exterior surface and greater than the groove diameter and configured to be accommodated within a case of the cartridge prior to discharge from the weapon. Upon discharge, the second right circular cylindrical exterior surface is deformed by the lands and grooves to form a seal with the barrel effective to substantially seal combustion gases behind the projectile during travel through the barrel. An aft portion of the projectile extends from the second plane to the heel and over a majority of its length, has a rearwardly tapering longitudinal profile.

The above stated objects, features and advantages will become more apparent from the specification and drawings that follow.

DETAILED DESCRIPTION

Figure 1:
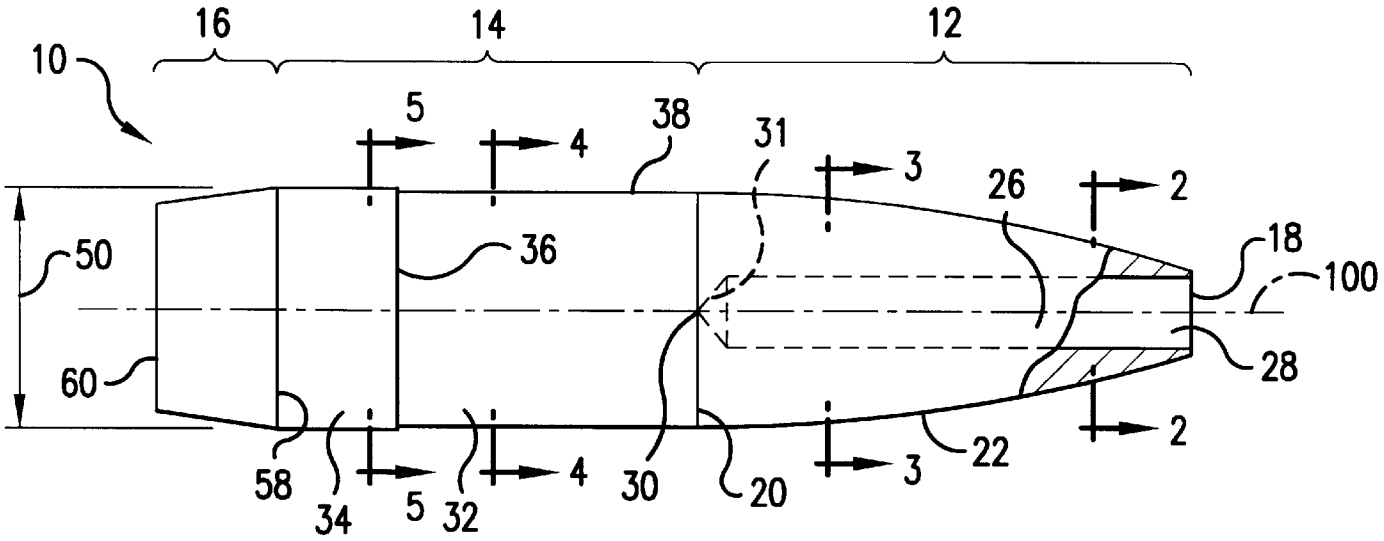
FIG. 1 illustrates in partial cross-section the projectile of the invention.

FIG. 1 illustrates in partial cross-sectional representation a medium caliber projectile 10 in accordance with the invention. The projectile 10 is monolithically formed from a single piece of copper alloy stock. The projectile 10 is formed from the metal stock by any suitable metal deformation process, including compressive forging and metal removal processes. Preferred for high speed, low cost manufacture is a metal removal process utilizing multiple-operation machining where a number of metal removal operations are completed on a single machine with a single set-up. Such removal processes include turning, cutoff, facing, drilling, boring, tapping and threading. The high volume production capabilities of the multiple operation machine makes the process cost effective.

Any machinable copper alloy may be utilized as the stock metal. A preferred type of alloy is a machinable brass (copper/zinc) alloy. Machinable brasses typically include lead or bismuth to enhance machinability. One suitable leaded brass alloy is designated by the Copper Development Association (CDA) as copper alloy C31400. This alloy has the nominal composition, by weight, of 87.5%–90.5% copper, 1.3%–2.5% lead and the balance zinc and inevitable impurities. A second suitable alloy is designated by the CDA as copper alloy C31600. This alloy has the nominal composition, by weight, of 87.5%–90.5% copper, 1.3%–2.5% lead, 0.7%–1.2% nickel and the balance zinc and inevitable impurities A machinable, lead-free, copper alloy is disclosed in reissued U.S. Pat No. 5,137,685 by McDevitt et al. where bismuth replaces at least a portion of the lead.

The projectile 10 is substantially symmetric about its central longitudinal axis 100 and has a fore portion 12, a mid-portion 14 and an aft portion 16.

The fore portion 12 extends from a nose 18 to a first transition plane 20. When viewed in longitudinal cross-section, as in FIG. 1, the fore portion 12 has arcuate sidewalls 22 with a radius of curvature several times the length of the projectile 10. Preferably, the radius of curvature of the arcuate sidewalls 22 is from about 1.5 times to about 5 times the length of the projectile 10 and more preferably, the radius of curvature is from about 2 times to about 3 times the length of the projectile. In the exemplary embodiment, the radius of curvature is substantially constant at a value of about 4.5 inches yielding a radius of curvature to projectile length ratio of 2.04:1.

Figure 3:
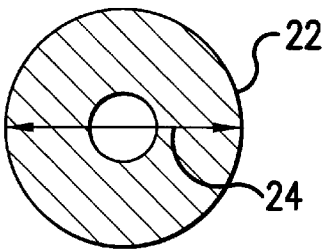
FIGS. 2 and 3 illustrate in cross-sectional representation latitudinal diameters of the fore portion of the projectile illustration the change in projectile diameter as a function of distance from the projectile nose.
Figure 2:
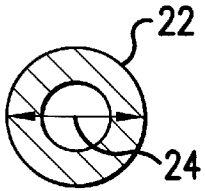

When viewed in latitudinal cross-section, perpendicular to the longitudinal cross-section of FIG. 1 as illustrated in FIGS. 2 and 3, the cross-sectional diameter of the fore portion 12 constantly increases when viewed in the direction from the nose 18 toward the first transition plane 20. The rate of increase is a function of the longitudinal distance from the nose 18. The ratio of the length of the fore portion 12 to the change in diameter between the nose 18 and the first transition plane 20 to the diameter is in the range of from about 2.5:1 to about 3.5:1. More preferably, such ratio is from about 2.8:1 to about 3.2:1.

Referring back to FIG. 1, the near tangential ogive of the side walls 22 resulting from the large radius of curvature minimizes bullet jump as described relative to the exemplary embodiment below. Bullet jump refers to a sudden change in orientation of the nose of the projectile brought about by engagement of the bullet with the rifling of the gun barrel and the alignment of the bullet nose with the axis of the gun barrel resulting from such engagement. The degree of bullet jump is affected by the distance the bullet travels before engaging the rifling. By minimizing the bullet jump, the ballistic accuracy of the projectile is greatly enhanced.

The projectile 10 has a hollow point. An interior bore 26 extends from an open end 28 at the nose 18 of the projectile to a closed end 30 that is proximate with the first transition plane 20. Preferably, the closed end 30 is within about 0.7 calibers (0.35 inch in the exemplary embodiment) of the first transition plane 20. More preferably, this closed end 30 is within about 0.3 calibers (0.15 inch in the exemplary embodiment) of the first transition plane 20.

The average diameter of the interior bore 26 is large relative to the latitudinal cross-sectional diameter of the projectile 10 as measured at the first transition plane 20. Typically, the diameter of the interior bore 26 will be from about 15% to about 40% of the latitudinal diameter of the projectile at the first transition plane 20 and preferably, from about 20% to about 30% of the latitudinal diameter at the first transition plane. The average interior bore diameter refers to the diameter of the interior bore over an extended length, disregarding e.g., a tapered diameter at the closed end that is typically caused by the machining tool.

The large metal-free volume occupied by the interior bore 26 shifts the center of gravity of the projectile 10 rearward, increasing the separation between the longitudinal center-point of the bullet and the center of gravity, further enhancing ballistic accuracy. The center of gravity is shifted rearward by about 0.15 calibers (0.075 inches in the exemplary embodiment).

The mid-portion 14 of the projectile 10 includes a body portion 32 and a drive band portion 34 separated by a second transition plane 36.

Figure 4:
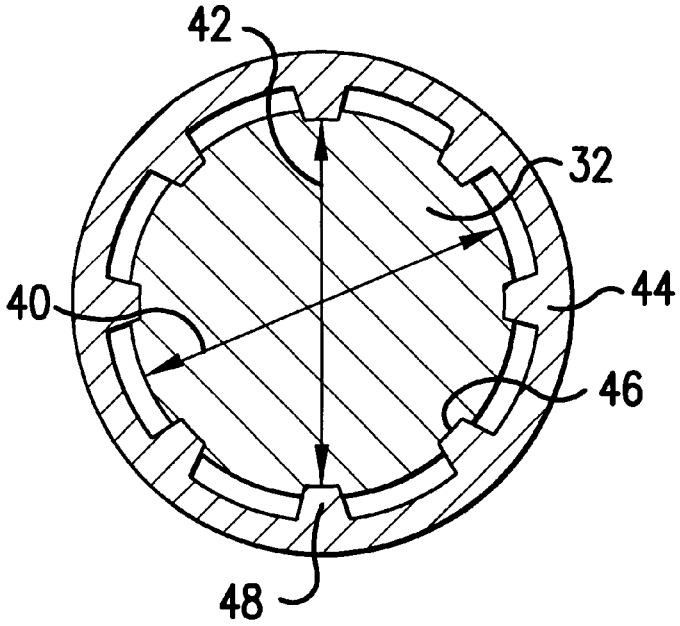
FIG. 4 illustrates in cross-sectional representation engagement of the body portion of the projectile with rifling of a gun barrel.

The body portion 32 has sidewalls 38 of generally constant latitudinal cross-sectional diameter. With reference to FIG. 4, the latitudinal diameter 40 of the body portion 32 is slightly larger than a first diameter of an interior bore 42 of the rifled barrel 44 of a weapon. The interior bore 42 first diameter, is measured between opposing peaks (lands) 46 of the rifling 48 and represents the largest diameter of a projectile that passes through the rifled barrel 44 without engaging rifling 48.

The latitudinal diameter 40 is that effective to minimally contact the rifling 48, whereby the nose 18 of the projectile is aligned with the axis of the gun barrel. Preferably, the latitudinal diameter 40 is from about 0.0005 inch to about 0.0025 inch greater than the first diameter of the interior bore. More preferably, the latitudinal diameter 40 is from about 0.001 inch to about 0.002 inch greater. Minimal contact between the body portion 32 and the rifling 48 minimizes barrel wear and improves the velocity to pressure ratio by reducing the force required to fully engrave the surface of the bullet. There is sufficient contact for the rifling 48 to provide required bullet alignment with the centerline of the bore. Bullet alignment is achieved by the rifling rather than the barrel groove surface.

Figure 5:
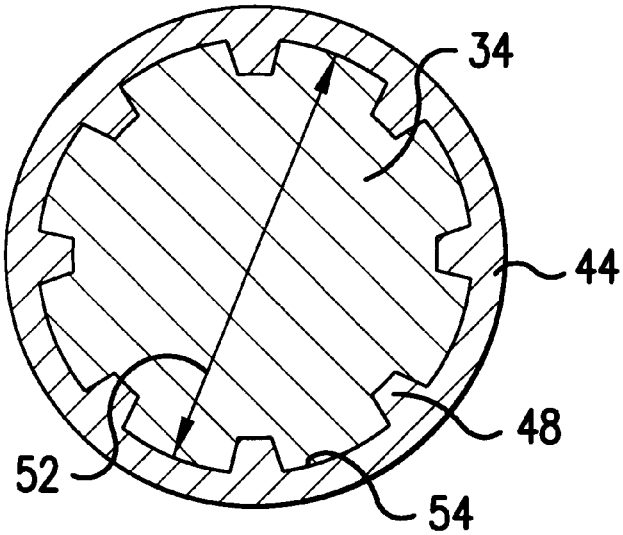
FIG. 5 illustrates in cross-sectional representation engagement of the drive band portion of the projectile with rifling of the gun barrel.

The drive band portion has a generally constant latitudinal diameter 50 (FIG. 1) that is slightly greater than a second diameter 52 (FIG. 5) of the barrel 44 when measured from opposing barrel groove surfaces 54. Deformation of the drive band by the rifling and groove surfaces provides a gas-tight seal between the projectile and barrel. A gas-tight seal provides for maximum velocity and minimum gas blowby around the projectile, both of which further enhance accuracy.

The drive band portion has a latitudinal diameter 50 effective to seal propellant gases behind a heel 60 of the projectile to maximize bullet velocity. Preferably, the latitudinal diameter 50 is from about 0.0005 inch to about 0.00025 inch greater than the barrel second diameter and, more preferably, from about 0.001 inch to about 0.002 inch greater.

With reference back to FIG. 1, the aft portion 16 has a latitudinal diameter that constantly decreases from a third transition plane 58 to the heel 60 of the projectile 10 forming a boattail to reduce drag and improve stability over long range.

The advantages of the invention will become more apparent from the Example that follows.

EXAMPLE

Figure 6:
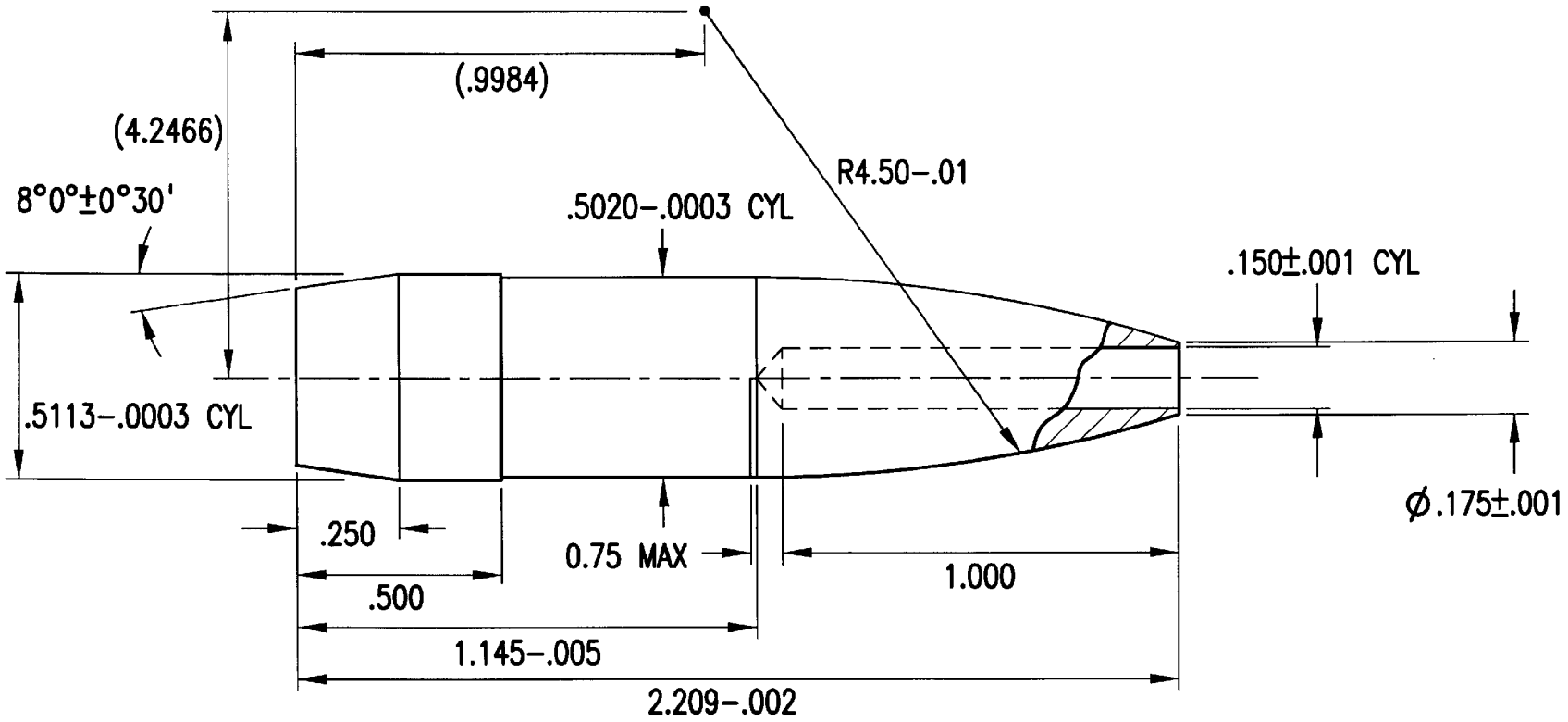
FIG. 6 illustrates in partial cross-sectional representation exemplary dimensions for the projectile of the invention.
Figure 7:
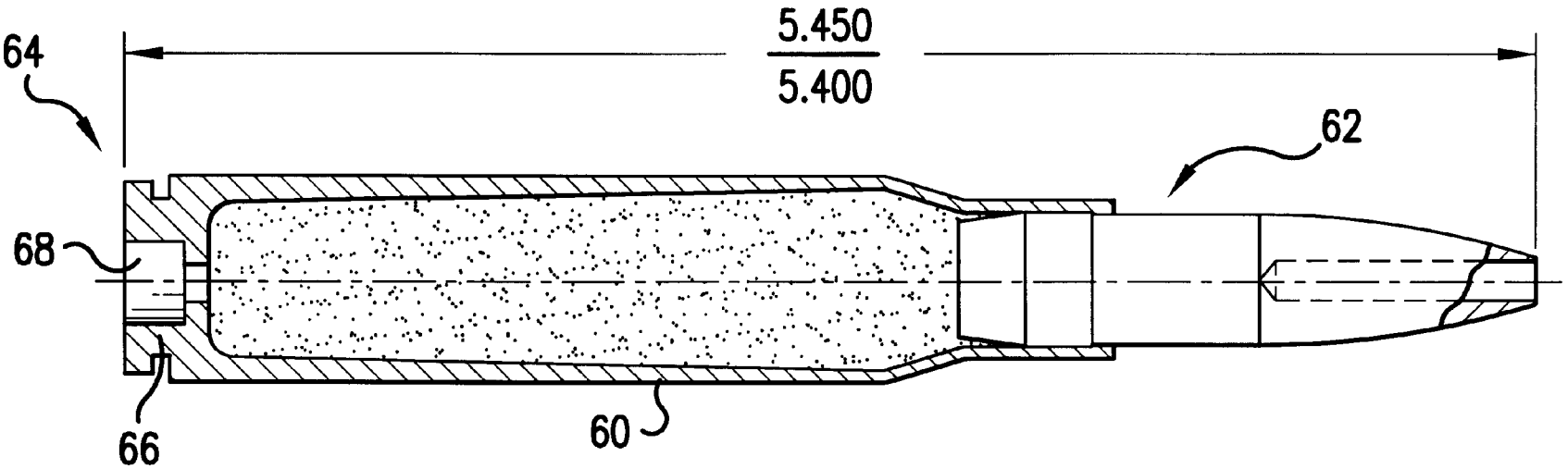
FIG. 7 illustrates in cross-sectional representation a cartridge incorporating a projectile of the invention.
Figure 8:
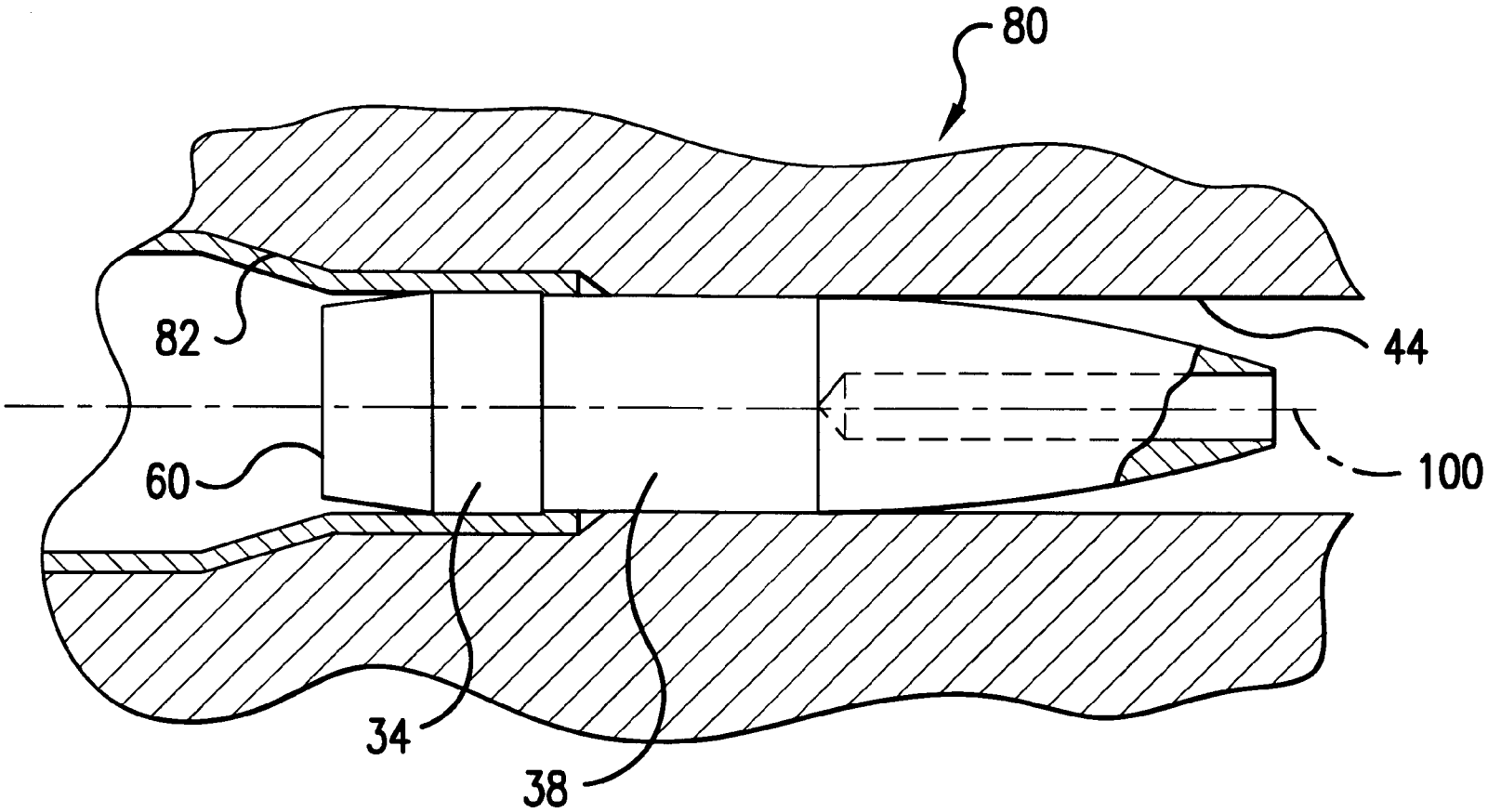
FIG. 8 illustrates in cross-sectional representation a cartridge incorporating a projectile of the invention chambered in a rifle.

FIG. 6 illustrates the projectile of the invention illustrating dimensions, in inches, effective for a 0.50 caliber cartridge shown in FIG. 7. The cartridge is compatible with a standard 0.50 caliber (12.75×99 mm) application as typified by U.S. Government Chamber Drawing 5564348, the disclosure of which is incorporated herein by reference in its entirety. The cartridge may be chambered in such a weapon 80 having a chamber 82 as shown in FIG. 8. The cartridge includes a conventional bottlenecked case 60 extending from mouth at a fore end 62 to an aft end 64. At the aft end, the case includes a head 66 which contains a cap-type percussion primer 68 in a cylindrical pocket. The interior of the case contains a propellant charge 70 to propel the projectile through the barrel of the weapon when ignited by the primer. The projectile is inserted through the cartridge mouth at the fore end 62 and into the cartridge neck with the case being crimped at the fore end 62 in front of the drive band 34 so as to retain the projectile in the case. The overall length of the cartridge is from 5.400 to a preferred 5.450 inches as in the standard 0.50 caliber cartridge. The standard length facilitates the use of the cartridge in conventional rifle magazines. The projectile has an overall length of from about 2.207 inches to a preferred 2.209 inches. The case may be a standard 0.50 caliber case having a length of from a preferred 3.725 inches to 3.731 inches.

The diameter 40 is advantageously from 0.5017 to a preferred 0.5020 inches, to cooperate with the standard land-to-land diameter of 0.500. The diameter 50 is between 0.5110 inches and a preferred 0.5113 inches cooperative with the standard groove-to-groove diameter of 0.510. The aft portion 16 or boattail extends 0.250±0.005 inches from the heel 60 and has a taper of from between 7.5 and 9.0 degrees from the third transition plane 58 to the heel 60. The second transition plane 36 is located 0.500±0.005 inches forward of the heel 60. The transition plane 20 is located between 1.140 and a preferred 1.145 inches forward of the heel. The interior bore 26 is formed as a circular cylinder of length 1.000±0.005 inches and diameter of 0.150±0.001 inches. A conical end extends up to about 0.075 inches aft past the cylindrical portion.

With these dimensions, the cylindrical body portion 32 extends about 0.66 inches forward of the case mouth, a significant distance which is in excess of the caliber of the projectile. In the exemplary embodiment, this exposed forward section of the body portion 32 will engage the rifling when the cartridge is assembled to approximately the maximum loaded length of 5.450 inches and chambered in the weapon from which it is to be fired. At shorter loaded lengths, there is no contact until discharge, with the travel distance until contact being the difference between actual and maximum loaded lengths. This reduces the degree of bullet jump relative to prior cartridges which have a longer secant radius ogive. This is facilitated by having a secant ogive which is nearly tangent, but not quite, as the provision of a tangent ogive would push the transition plane 20 farther back. The relatively forward location of the transition plane 20 is further facilitated by the particular use of a hollow point configuration which, for an ogive of a given approximate curvature allows the surface of the ogive to be relatively longitudinally closer to the nose than with a sharp point.

The weight of the projectile when manufactured from either copper alloy C31400 or C31600 is 750±2 grains. Other caliber projectiles such Cal. 0.30 would be best formed by appropriate scaling of these dimensions. Although advantageously applied to calibers of 0.50 or less and more advantageously to calibers from 0.30 through 0.50, the invention may be practiced with other calibers of ammunition.

PERFORMANCE:

In comparative performance testing, the exemplary projectile was fired from a cartridge loaded with WC869 propellant which was selected to substantially fill the cartridge case and, thereby, minimize any velocity variation due to shifting of the propellant. Average velocity change due to powder position was only 44 feet per second (fps) whereas other Cal 0.50 cartridges typically have velocity changes of up to 150 fps. Minimizing velocity variation due to powder position is important in obtaining good long-range accuracy since the bullet's trajectory is affected by muzzle velocity. The cartridge (designated "E.O. 6172") was compared to Mk211 multipurpose (MPC) cartridges produced by Olin Corporation and to M33 ball cartridges produced by Olin Corporation and M33 match cartridges produced by Israel Military Industries (IMI). Tests were conducted at 200 yards and 1000 meters (except for the MPC round which could not be tested at 1000 meters due to range restrictions).

1. Velocity and Pressure, 36" test barrels

| Temp | | Velocity @ 78' (FPS) | | | Pressure (Cup/100) | | | Powder |
|---|---|---|---|---|---|---|---|---|
| (° F.) | N | Avg. | EV | SD | Avg. | EV | SD | Position* |
| 70 | 20 | 2962 | 63 | 17 | 517 | 49 | 14 | P @ P |
| 70 | 10 | 3006 | 77 | 28 | 564 | 17 | 8 | P @ B |
| 125 | 20 | 3022 | 56 | 14 | 541 | 20 | 10 | P @ P |
| 125 | 10 | 3048 | 19 | 7 | 561 | 17 | 7 | P @ B |
| −50 | 20 | 2961 | 86 | 23 | 562 | 49 | 16 | P @ P |
| −50 | 10 | 2965 | 35 | 14 | 571 | 29 | 13 | P @ B |

*P @ P = powder @ primer; P @ B = powder @ bullet

2. Accuracy @ 200 yards, 10–5 shot targets, 36" test barrels

| | E.O. 6172 | MK211 | M33 Match |
|---|---|---|---|
| Average E.S. (in.)* | 2.50 | 2.94 | 4.17 |
| Average M.R.** | .83 | 1.10 | 1.63 |
| Minutes of Angle of E.S. | 1.19 | 1.40 | 1.99 |

*Extreme spread
**Mean radius

3. Accuracy and Mismatch (vs. M33 Ball) @ 1000-meters, 10–5 shot targets for 750 g. Match, 3–5 shot targets for M33 Ball, 36" test barrel.

| | E.O. 6172 | M33 Ball |
|---|---|---|
| Average E.S. (in.) | 13.50 | 40.46 |
| Average M.R. (in.) | 4.75 | 11.44 |
| Minutes of Angle of E.S. | 1.18 | 3.54 |
| Mismatch vs. M33 (in., mils) | +9.94, 0.25 | — |

It is apparent that there has been provided in accordance with this invention a medium caliber projectile that fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to enhance all such alternatives, modifications and variations as fall within the spirit and broad scope of the appended claims.

I claim:

1. A projectile to be fired from a weapon having a rifled barrel, said rifled barrel having an interior bore of a first diameter and a barrel groove surface of a second diameter greater than said first diameter, said projectile comprising:

a monolithic copper alloy of generally circular exterior latitudinal cross-section having a fore portion and an aft portion with a mid-portion disposed therebetween;

said fore portion extending from a nose thereof to a first transition plane and having arcuate sidewalls when viewed in longitudinal cross-section, that constantly increase in latitudinal exterior cross-sectional diameter from said nose to said first transition plane, a hollow cylindrical bore extending from an open end of said nose to a closed end proximate to said first transition plane;

said mid-portion having a body portion of generally constant latitudinal cross-section extending from said first transition plane to a second transition plane and a drive band portion of generally constant latitudinal cross-section extending from said second transition plane to a third transition plane, said body portion having a latitudinal diameter slightly greater than said first diameter but less than said second diameter and effective to minimally contact said rifling of said rifled barrel and said drive band having a latitudinal diameter greater than said body portion latitudinal diameter and effective to seal propellant gases behind a heel of said projectile; and said aft portion having a latitudinal diameter that constantly decreases from said third transition plane to said heel.

2. The projectile of claim 1 wherein said body portion latitudinal diameter is from about 0.0005 inch to about 0.0025 inch greater than said interior bore first diameter.

3. The projectile of claim 2 wherein said body portion latitudinal diameter is from about 0.001 inch to about 0.002 inch greater than said interior bore first diameter.

4. The projectile of claim 2 wherein said drive band portion latitudinal diameter is from about 0.0005 inch to about 0.0025 inch greater than said barrel groove surface second diameter.

5. The projectile of claim 4 wherein said drive band portion latitudinal diameter is from about 0.001 inch to about 0.002 inch greater than said barrel groove surface second diameter.

6. The projectile of claim 4 wherein said arcuate sidewalls have a radius of curvature that is from about 1.5 to about 5 times a length of said projectile.

7. The projectile of claim 6 wherein said arcuate sidewalls have a radius of curvature that is from about 2 to about 3 times said length of said projectile.

8. The projectile of claim 6 wherein said closed end of said hollow cylindrical bore is within about 0.7 calibers of said first transition plane.

9. The projectile of claim 8 wherein said closed end of said hollow cylindrical bore is within about 0.3 calibers of said first transition plane.

10. The projectile of claim 8 wherein said monolithic copper alloy is brass.

11. The projectile of claim 10 wherein said monolithic copper alloy is selected from the group consisting of copper alloy C31400 and C31600.

12. The projectile of claim 11 being a 0.50 caliber projectile.

13. The projectile of claim 1 having a nominal caliber of 0.50 or less.

14. A projectile configured to be incorporated into a cartridge and to be fired from a weapon having a rifled barrel, said rifled barrel having barrel land surface of a land diameter and a barrel groove surface of a groove diameter, said projectile extending along a projectile length from a nose to a heel along a central longitudinal axis and consisting essentially of a monolithically formed copper alloy combination of:

a fore portion extending aft along a first length, at least thirty percent of the projectile length, from the nose to a first plane and over a majority of the first length having a continuously curving convex longitudinal profile;

a mid-portion extending aft along a second length from the first plane to a second plane and having:

a fore subportion having a third length at least equal in dimension to the land diameter, over a majority of the third length having a longitudinal profile defining a first right circular cylindrical exterior surface of a first diameter slightly larger than the land diameter and configured to cooperate with the barrel land surface to register the projectile centrally within the barrel when the cartridge is chambered in the weapon; and an aft subportion having a fourth length, over a majority of the fourth length having a longitudinal profile defining a second right circular cylindrical exterior surface of a second diameter greater than the first diameter and greater than the groove diameter and configured to be accommodated within a case of the cartridge prior to discharge of the weapon and, upon discharge of the weapon, to engage the barrel so as to be deformed by the barrel land and groove surfaces and form a seal with the barrel effective to substantially seal combustion gasses behind the projectile during travel through the barrel; and an aft portion extending aft along a fifth length from the second plane to the heel and over a majority of the fifth length having a rearwardly tapering longitudinal profile.

15. The projectile of claim 14 wherein the nose is truncated.

16. The projectile of claim 15 having a cavity extending rearward from the nose.

17. The projectile of claim 15 wherein the nose bounds a fore end of a central longitudinal channel extending aft along the longitudinal axis and terminating in close proximity to the first plane.

18. The projectile of claim 17 wherein the first diameter exceeds the land diameter by a first amount of about 0.0005 inch to about 0.0025 inch and the second diameter exceeds the groove diameter by a second amount from about 0.0005 inch to about 0.0025 inch.

19. The projectile of claim 18 wherein the projectile is a nominal 0.50 caliber projectile.

20. The projectile of claim 18 wherein the first diameter is from about 0.5017 inches to about 0.5020 inches and the second diameter is from about 0.5110 inches to about 0.5113 inches.

21. A projectile configured to be incorporated into a cartridge and to be fired from a weapon having a rifled barrel, said rifled barrel having barrel land surface of a land diameter and a barrel groove surface of a groove diameter, said projectile extending along a projectile length from a nose to a heel along a central longitudinal axis and comprising a monolithically formed copper alloy combination of:

a fore portion extending aft along a first length, at least thirty percent of the projectile length, from the nose to a first plane and over a majority of the first length having a continuously curving convex longitudinal profile and having a central cavity extending rearward from the nose;

a mid-portion extending aft along a second length from the first plane to a second plane and having:

a fore subportion having a third length at least equal in dimension to the land diameter, over a portion of the third length having a diameter slightly larger than the land diameter, but less than the groove diameter and configured to cooperate with the barrel land surface to register the projectile centrally within the barrel when the cartridge is chambered in the weapon; and an aft subportion having a fourth length, over a majority of the fourth length having a diameter greater than the the groove diameter and configured to be accommodated within a case of the cartridge prior to discharge of the weapon and, upon discharge of the weapon, to engage the barrel so as to be deformed by the barrel land and groove surfaces and form a seal with the barrel effective to substantially seal combustion gasses behind the projectile during travel through the barrel; and an aft portion extending aft along a fifth length from the second plane to the heel and over a majority of the fifth length having a rearwardly tapering longitudinal profile.

* * * * *